US008396407B2

(12) United States Patent
Lee

(10) Patent No.: US 8,396,407 B2
(45) Date of Patent: Mar. 12, 2013

(54) FUSING DEVICE AND IMAGE FORMING APPARATUS HAVING THE SAME

(75) Inventor: Jin Sung Lee, Seoul (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 69 days.

(21) Appl. No.: 12/971,304

(22) Filed: Dec. 17, 2010

(65) Prior Publication Data

US 2011/0158720 A1 Jun. 30, 2011

(30) Foreign Application Priority Data

Dec. 28, 2009 (KR) ..... 10-2009-0131783

(51) Int. Cl.
*G03G 15/20* (2006.01)

(52) U.S. Cl. ..... 399/329

(58) Field of Classification Search ..... 399/329, 399/330

See application file for complete search history.

(56) References Cited

U.S. PATENT DOCUMENTS

| | | | | |
|---|---|---|---|---|
| 6,002,910 | A * | 12/1999 | Eddy et al. | 399/329 |
| 2004/0156661 | A1 * | 8/2004 | Kagawa et al. | 399/328 |
| 2005/0286926 | A1 * | 12/2005 | Chae et al. | 399/88 |
| 2009/0016789 | A1 * | 1/2009 | Kim et al. | 399/329 |
| 2010/0104332 | A1 * | 4/2010 | Law et al. | 399/328 |

FOREIGN PATENT DOCUMENTS

| | | |
|---|---|---|
| KR | 2020000000485 | 1/2000 |
| KR | 1020080044372 | 5/2008 |

* cited by examiner

*Primary Examiner* — Walter L Lindsay, Jr.
*Assistant Examiner* — Frederick Wenderoth
(74) *Attorney, Agent, or Firm* — Stanzione & Kim, LLP

(57) ABSTRACT

A fusing device to improve an amount of heat to a recording medium, and an image forming apparatus having the same, includes a heating unit having a heat source and a press roller arranged to come into contact with and to press an outer circumferential surface of the heating unit so as to define a fusing nip. The press roller includes an elastic layer and at least one heating element contained in the elastic layer to allow generation of heat from the interior of the elastic layer. The heating element may include heating particles dispersed in the elastic layer, or may be a sheet type heating element inserted in the elastic layer.

20 Claims, 14 Drawing Sheets

FUSING DEVICE AND IMAGE FORMING APPARATUS HAVING THE SAME

CROSS-REFERENCE TO RELATED APPLICATIONS

This application claims priority under 35 U.S.C. §119(a) from Korean Patent Application No. 2009-0131783, filed on Dec. 28, 2009 in the Korean Intellectual Property Office, the disclosure of which is incorporated herein by reference.

BACKGROUND

1. Field of the Invention

Exemplary embodiments of the present general inventive concept relate to a fusing device to fix an image to a recording medium by applying heat to the image and an image forming apparatus having the same.

2. Description of the Related Art

Image forming apparatuses are devised to print an image on a recording medium. Examples of image forming apparatuses include printers, copiers, fax machines, and devices combining functions thereof.

In an electro-photographic image forming apparatus, after light is irradiated to a photosensitive member charged with a predetermined electric potential to form an electrostatic latent image on a surface of the photosensitive member, a developer is fed to the electrostatic latent image, forming a visible image. The visible image, formed on the photosensitive member, is transferred to a recording medium. The visible image transferred to the recording medium is fixed to the recording medium while passing through a fusing device.

A generally widely used fusing device includes a heating roller having a heat source therein, and a press roller arranged to come into close contact with the heating roller so as to define a fusing nip. When a recording medium onto which an image has been transferred enters the fusing nip between the heating roller and the press roller, the image is fixed to the recording medium under the influence of heat and pressure inside the fusing nip.

With the recent tendency of higher print speed of an image forming apparatus, it may be necessary to improve fusing performance via more effective heat transfer to a recording medium.

SUMMARY

It is a feature of the present general inventive concept to provide a fusing device having an improvement to supply a sufficient amount of heat to a recording medium and an image forming apparatus having the same.

Additional features of the general inventive concept will be set forth in part in the description which follows and, in part, will be obvious from the description, or may be learned by practice of the general inventive concept.

In accordance with one feature of the general inventive concept, a fusing device usable with an image forming apparatus to apply heat and pressure to a recording medium passing through a fusing nip, includes a heating unit having a heat source to generate heat, and a press roller arranged to come into contact with and to press the heating unit, wherein the press roller includes a shaft, an elastic layer arranged to cover a periphery of the shaft and having elasticity to define the fusing nip when the press roller comes into compressive contact with and presses the heating unit, and heating particles dispersed in the elastic layer to allow generation of heat from the interior of the elastic layer.

The heating particles may include carbon particles.

The fusing device may further include an insulation layer arranged between the shaft and the elastic layer to electrically insulate the shaft from the elastic layer.

The fusing device may further include an annular terminal arranged at either axial end of the press roller so as to be rotated along with the press roller and electrically connected to the elastic layer.

The fusing device may further include a roller cap made of an electrically insulating material and coupled to the axial end of the press roller so as to be rotated along with the press roller, the roller cap being configured to accommodate the annular terminal therein, and a connection terminal penetrating through the roller cap to connect the elastic layer and the annular terminal to each other.

The heating unit may include a fusing belt arranged to circulate around the heat source, a supporting member arranged to support a part of an inner circumferential surface of the fusing belt and having an opening to allow the heat generated by the heat source to be directly radiated to the fusing belt, and a nip defining member arranged to support the inner circumferential surface of the fusing belt and having a press portion opposite the press roller to define the fusing nip between an outer circumferential surface of the fusing belt and the press roller.

In accordance with another feature of the general inventive concept, a fusing device usable with an image forming apparatus to apply heat and pressure to a recording medium passing through a fusing nip includes a heating unit having a heat source to generate heat, and a press roller arranged to come into contact with and to press the heating unit, wherein the press roller includes a shaft, an elastic layer arranged to cover a periphery of the shaft and having elasticity to define the fusing nip when the press roller comes into compressive contact with and presses the heating unit, and at least one sheet type heating element inserted into the elastic layer to allow generation of heat from the interior of the elastic layer.

The at least one sheet type heating element may include unit patterns extending in a circumferential direction of the press roller, and the unit patterns may be arranged with an interval therebetween in an axial direction of the press roller.

A gap between the unit patterns of the sheet type heating element, arranged at axial both sides of the press roller, may be narrower than a gap between the unit patterns of the sheet type heating element arranged at the axial center of the press roller.

A width of the unit patterns of the sheet type heating element, arranged at axial both sides of the press roller, may be narrower than a width of the unit patterns of the sheet type heating element arranged at the axial center of the press roller.

The at least one sheet type heating element may include unit patterns extending in an axial direction of the press roller, and the unit patterns may be arranged with an interval therebetween in a circumferential direction of the press roller.

The elastic layer may include an inner layer and an outer layer arranged inside and outside of the at least one sheet type heating element in a radial direction of the press roller.

The at least one sheet type heating element may include a plurality of sheet type heating elements arranged in an axial direction of the press roller to enable independent control of the amount of heat generated from the respective sheet type heating elements.

The at least one sheet type heating element may be made of a metal sheet having a thickness of about 30 μm to about 100 μm.

The fusing device may further include a roller cap made of an electrically insulating material and coupled to either axial end of the press roller so as to be rotated along with the press roller, and at least one terminal accommodated in the roller cap so as to be electrically connected to the at least one sheet type heating element.

In accordance with a further feature of the general inventive concept, an image forming apparatus includes a fusing device to apply heat and pressure to a recording medium passing through a fusing nip so as to fix a non-fused image to the recording medium, wherein the fusing device includes a fusing belt arranged to come into contact with a surface of the recording medium on which the non-fused image is formed, so as to transfer heat to the surface of the recording medium, a heat source configured to generate heat and arranged to directly radiate the heat to at least a part of an inner circumferential surface of the fusing belt, a press roller arranged to come into contact with and to press an outer circumferential surface of the fusing belt, and a nip defining member arranged to support the inner circumferential surface of the fusing belt while being arranged opposite the press roller to define the fusing nip between the outer circumferential surface of the fusing belt and the press roller, and wherein the press roller includes a shaft, an elastic layer arranged to cover a periphery of the shaft and having elasticity to define the fusing nip when the press roller comes into contact with and presses the heating unit, and at least one heating element accommodated in the elastic layer to allow generation of heat from the interior of the elastic layer.

The at least one heating element may include heating particles dispersed in the elastic layer to generate heat upon receiving electric power supplied to the elastic layer.

The heating particles may include carbon nanotubes.

The at least one heating element may include at least one sheet type heating element inserted into the elastic layer.

The image forming apparatus may further include a power source, and a power supply terminal electrically connected to the power source and arranged at the outside of the press roller, and the fusing device may further include a roller cap made of an electrically insulating material and coupled to either axial end of the press roller so as to be rotated along with the press roller, and a terminal accommodated in the roller cap so as to come into contact with the power supply terminal and electrically connected to the heating element.

BRIEF DESCRIPTION OF THE DRAWINGS

These and/or other features of the general inventive concept will become apparent and more readily appreciated from the following description of exemplary embodiments, taken in conjunction with the accompanying drawings of which.

DETAILED DESCRIPTION OF THE EMBODIMENTS

Figure 1:
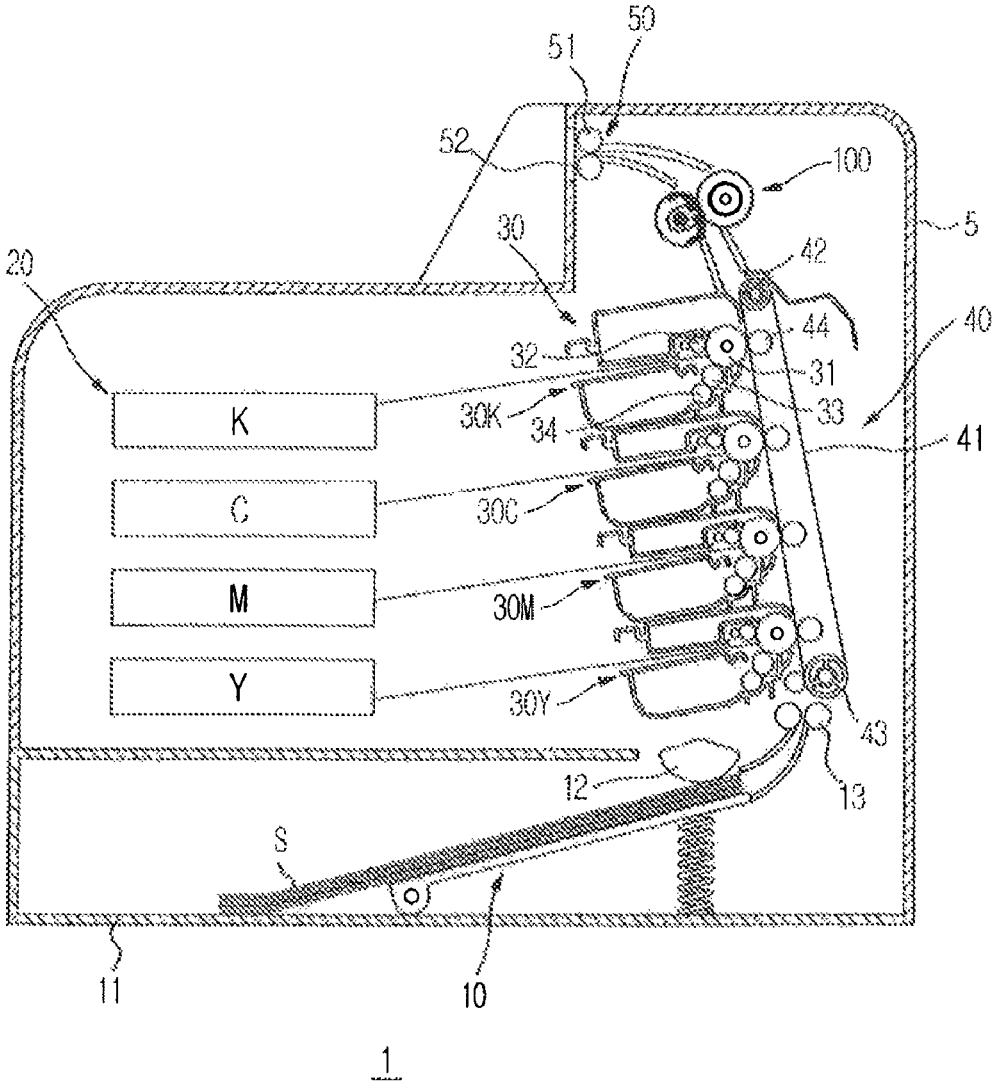
FIG. 1 is a view illustrating a configuration of an image forming apparatus according to an exemplary embodiment of the present general inventive concept.

Reference will now be made in detail to exemplary embodiments of the present general inventive concept, examples of which are illustrated in the accompanying drawings, wherein like reference numerals refer to like elements throughout. FIG. 1 is a view illustrating a configuration of an image forming apparatus according to an exemplary embodiment of the present general inventive concept.

As illustrated in FIG. 1, an image forming apparatus 1 includes a body 5, a recording medium supply device 10, a light scanning device 20, a developing device 30, a transfer device 40, a fusing device 100, and a recording medium discharge device 50.

The body 5 defines an external appearance of the image forming apparatus 1 and supports a variety of elements installed therein. A part of the body 5 may be configured to be opened or closed. This allows a user to exchange or repair the variety of elements through the open part of the body 5 or to remove a recording medium jammed in the body 5.

The recording medium supply device 10 supplies a recording medium S to the developing device 30. The recording medium may include one or more sheets of recording medium having front and rear surfaces, such as sheets of paper. The recording medium supply device 10 includes a cassette 11 detachably mounted in the body 5. The recording medium S is accommodated in the cassette 11 and is picked up sheet by sheet by a pickup roller 12 during a printing operation. The recording medium S picked up by the pickup roller 12 is fed to the developing device 30 by a feed roller 13.

The light scanning device 20 forms an electrostatic latent image by irradiating light corresponding to image information input from an external appliance, such as a computer, onto a photosensitive member 31. In the case of the color image forming apparatus as illustrated in FIG. 1, the light scanning device 20 is configured to irradiate light corresponding to Yellow, Magenta, Cyan and Black colors onto the photosensitive member 31.

The developing device 30 may include four developing units 30Y, 30M, 30C and 30K in which different colors of developers, e.g., yellow, magenta, cyan and black developers Y, M, C and K are received respectively. Although the photosensitive member 31 may be provided in each of the developing units 30Y, 30M, 30C and 30K, the photosensitive member 31 may be separated from the corresponding developing unit.

Each of the developing units 30Y, 30M, 30C and 30K includes a charging roller 34 to electrically charge the photosensitive member 31, a developing roller 33 to supply the developer to the electrostatic latent image formed on the photosensitive member 31 so as to form a visible image, and a supply roller 34 to supply the developer to the developing roller 33.

The transfer device 40 transfers the developer image formed on the photosensitive member 31 to the recording medium S. The transfer device 40 includes a transfer belt 41 adapted to circulate while in contact with the respective photosensitive members 31, a transfer belt driving roller 42 to drive the transfer belt 41, a tension roller 43 to maintain tension of the transfer belt 41, and four transfer rollers 44 to transfer the developer images formed on the respective photosensitive members 31 to the recording medium S.

The recording medium S is fed while being adhered to the transfer belt 41. In this case, a voltage having a polarity opposite to that of the developer attached to the photosensitive member 31 is applied to the transfer roller 44, causing the developer image on the photosensitive member 31 to be transferred to the recording medium S.

The fusing device 100 is configured to apply heat and pressure to the recording medium S so as to fix a non-fused image on the recording medium S to the recording medium S. A detailed description related to the fusing device 100 will be described hereinafter.

The recording medium discharge device 50 discharges the recording medium S having passed through the fusing device 100 out of the image forming apparatus 1. The recording medium discharge device 50 includes a discharge roller 51 and a discharge backup roller 52 arranged to face each other.

Figure 2:
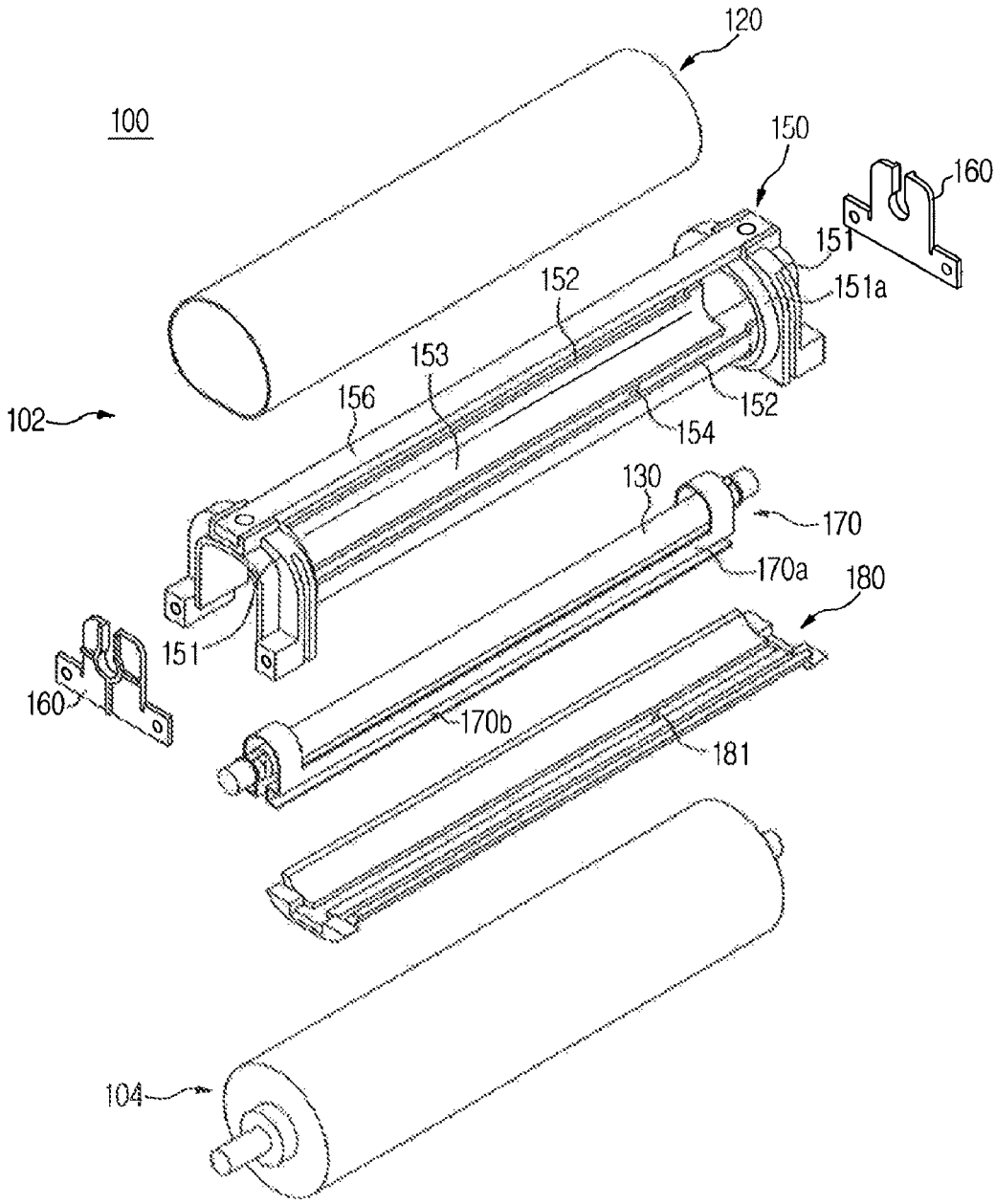
FIGS. 2 and 3 are respectively an exploded perspective view and a sectional view illustrating a configuration of a fusing device according to an exemplary embodiment of the present general inventive concept.
Figure 3:
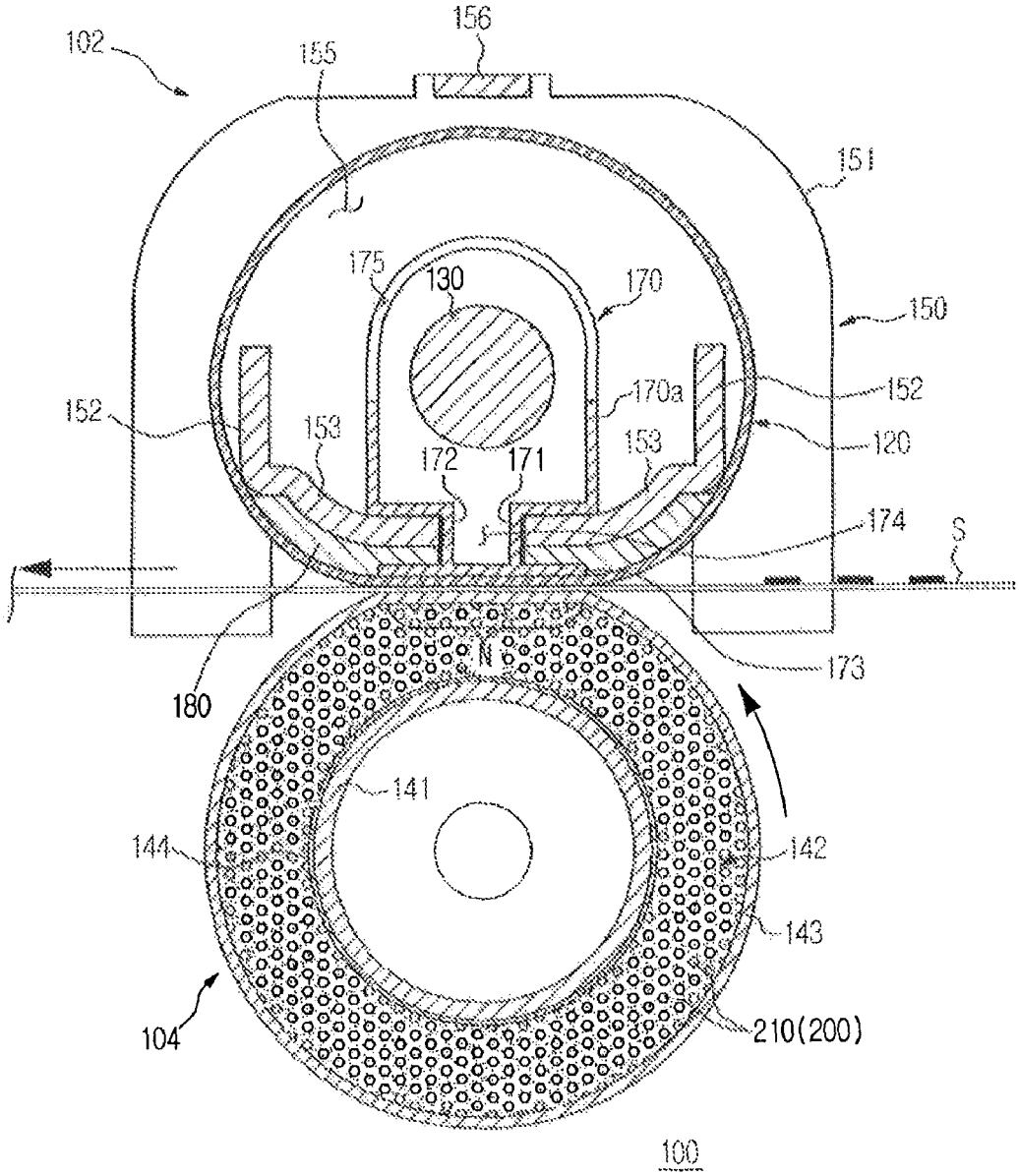

FIGS. 2 and 3 illustrate an exploded perspective view and a sectional view illustrating a configuration of the fusing device, respectively, according to an exemplary embodiment of the present general inventive concept. In FIG. 2, illustration of a partial configuration is omitted. Additionally, FIG. 4 illustrates a configuration of the press roller included in the fusing device and a configuration to supply power to the press roller according to an exemplary embodiment of the present general inventive concept.

Figure 4:
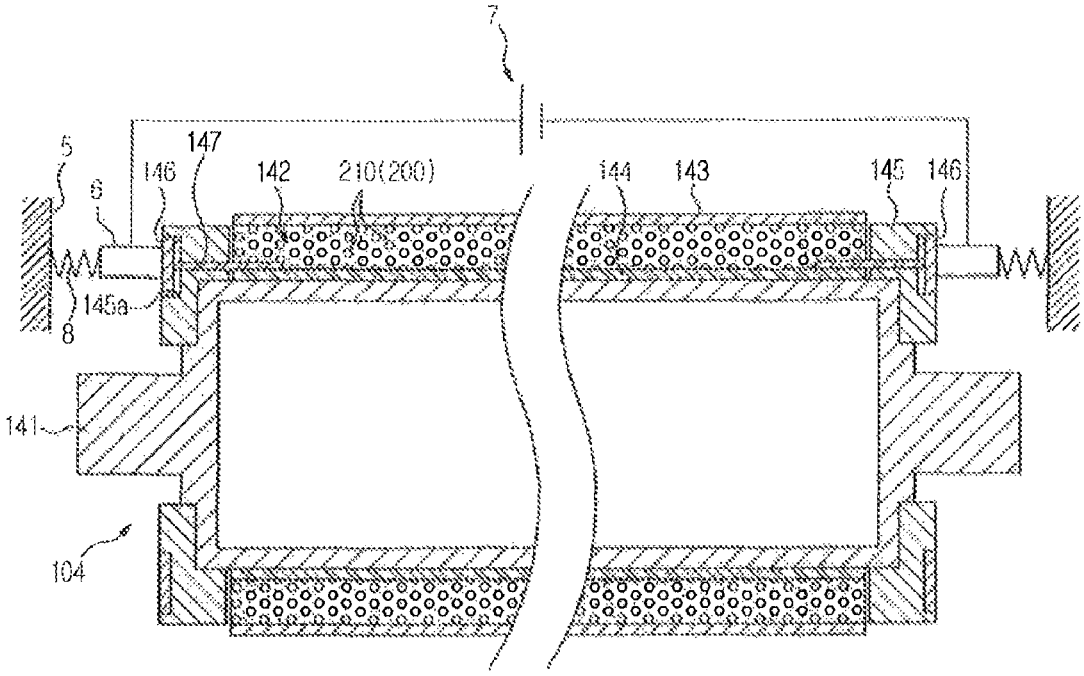
FIG. 4 is a view illustrating a configuration of a press roller included in the fusing device and a configuration to supply power to the press roller according to an exemplary embodiment of the present general inventive concept.

Referring now to FIGS. 2 to 4, the fusing device 100 includes a heating unit 102 having a first rotational member, including, but not limited to, a fusing belt 120 to emit heat. The fusing device 100 may further include a second rotational member, such as a pressing roller 104 that may emit heat separately from the heat emitted by the heating unit 102, as discussed in greater detail below.

The heating unit 102 and the press roller 104 are arranged to face each, so as to define a fusing nip N through which the recording medium S passes. Accordingly, the press roller 104 and the fusing belt may be rotated such that the recording medium S passes therebetween via the nip N. In a state where the image on a surface of the recording medium S is not yet fused, the heating unit 102 may come into contact with a surface of the recording medium S thus transferring heat to the recording medium S. The press roller 104 comes into contact with and presses against the heating unit 102, thereby contacting an opposite side of the recording medium S.

The heating unit 102 further includes a heat source 130, a supporting member 150, a nip defining member 170 and a belt guide member 180. As mentioned above, the recording medium S, onto which the developer image has been transferred, passes through the fusing nip N between the press roller 104 and the fusing belt 120. At this time, the developer image may be fixed to the recording medium S upon receiving heat and pressure.

The fusing belt 120 is rotatably supported on the supporting member 150 and is rotated while being engaged with the press roller 104. The fusing belt 120 is heated by the heat source 130 thus acting to transfer heat to the recording medium S passing through the fusing nip N.

More specifically, the heat source 130 may be arranged adjacent to the fusing belt 120. For example, exemplary embodiment illustrated in FIGS. 2-4 dispose the heat source 130 in a hollowed area defined by the fusing belt 120, thereby disposing the heat source 130 inside the fusing belt 120. Both ends of the heat source 130 are coupled respectively to side covers 160. The side covers 160 are fixed to the supporting member 150 so that the heat source 130 is supported by the supporting member 150. The heat source 130 may include, but is not limited to, at least one halogen lamp. For example, a halogen lamp may emit heat, which is absorbed by the surrounding fusing belt 120.

The supporting member 150 is arranged to surround the heat source 130 and is made of a high strength material so as not to be easily deformed by external force. The supporting member 150 may include end pieces 151, linear supporting plates 152, and bending plates 153.

The end pieces 151 are arranged respectively at both ends of the supporting member 150 and each has an inwardly protruding belt supporting portion 151*a* formed at an inner surface thereof to support a corresponding end of the fusing belt 120.

The supporting plates 152 extend between the end pieces 151 in a width direction of the supporting member 150 to connect the end pieces 151 to each other. The supporting plates 152 are spaced apart in parallel from each other.

The bending plates 153 are bent inward from the respective supporting plates 152. A first opening 154 is defined between the bending plates 153. An amount of heat emitted from the heat source 130 is transferred to the fusing nip N through the first opening 154.

The supporting member 150 defines a second opening 155 at a side opposite the first opening 154. The second opening 155 allows radiative heat from the heat source 130 to directly reach the fusing belt 120 across the supporting member 150.

The supporting member 150 may further include a reinforcement plate 156 to connect the end pieces 151 to each other at the outside of the fusing belt 120. The reinforcement plate 156 increases the strength of the supporting member 150 to prevent deformation of the supporting member 150.

The nip defining member 170 supports an inner surface of the fusing belt 120 to define the fusing nip N between the press roller 104 and the fusing belt 120.

The nip defining member 170 includes a body section 170*a* and a nip defining section 170*b*. The nip defining section 170*b* includes a first extension 171 extending from one end of the body 170*a* toward the fusing belt 120, a second extension 172 extending from the other end of the body 170*a* toward the fusing belt 120, and a press portion 173 provided at ends of the first extension 171 and the second extension 172. The press portion 173 supports the inner surface of the fusing belt 120 to enable creation of the fusing nip N.

A nip heating region 174 is defined between the first extension 171 and the second extension 172. The heat source 130 heats the press portion 173 by directly applying radiative heat through the nip heating region 174 of the nip defining member 170. Accordingly, the heated press portion 173 transfers heat to the fusing belt 120.

The nip defining member 170 may be made of including, but not limited to, a metallic material having a low specific heat and high thermal conductivity, so that a temperature of the nip defining member 170 rapidly rises to effectively transfer heat to the fusing belt 120 and the recording medium S.

The body section 170*a* of the nip defining member 170 has an opening 175 at an opposite side of the nip heating region 174. The heat source 130 may directly apply radiative heat to the fusing belt 120 through the opening 175 of the nip defining member 170 and the second opening 155 of the supporting member 150. This may rapidly increase the temperature of the fusing belt 120 and may prevent deterioration in the temperature of the fusing belt 120 during rotation of the fusing belt 120.

The belt guide member 180 supports the inner surface of the fusing belt 120 near the fusing nip N to guide the fusing belt 120. An upper portion of the belt guide member 180 is supported by the supporting member 150. The belt guide member may further include a perforated opening portion 181 in the center of the belt guide member 180 corresponding to the nip heating region 174 of the nip defining member 170.

A lower surface of the belt guide member 180 supports the press portion 173 of the nip defining member 170 against the press force applied from the press roller 104. An inner edge of the belt guide member 180 defining the opening 181 supports outer sides of the first extension 171 and the second extension 172 of the nip defining member 170, to prevent expansion of the nip heating region 174 of the nip defining member 170.

As discussed above, the press roller 104 is arranged to face the fusing belt 120 and defines the fusing nip N when being pressed toward the fusing belt 120 by a press device (not shown). The press device may include, but is not limited to, a spring. The press roller 104 is rotated upon receiving power from a drive source (not shown) mounted in the body 5 of the image forming apparatus 1.

The press roller 104 includes a shaft 141 and an elastic layer 142 surrounding the shaft 141. The shaft 141 is located in the center of the press roller 104 and serves as a rotating shaft to support components thereon. The shaft 141 may be made of metal such as aluminum or steel. The press roller 104 further includes at least one elastic layer 124 arranged to cover the periphery of the shaft 141. The elastic roller 124 is elastically deformed as the press roller 104 is pressed toward the fusing belt 120, defining the fusing nip N with the fusing belt 120. The elastic layer 142 may be made of an elastomer material, including, but not limited to, rubber.

A release layer 143 is provided on a surface of the elastic layer 142 to prevent the recording medium S from adhering to the press roller 104. The release layer 143 may include, but is not limited to, a perfluoroalkoxy (PFA) tube.

As illustrated in FIGS. 3 and 4, in the fusing device 100 according to the exemplary embodiment of the present general inventive concept, at least one heating element 200 is disposed in the elastic layer 142 of the press roller 104. Accordingly, it may be possible to effectively supply a sufficient amount of heat to the recording medium S using heat generated from the interior of the elastic layer 142 and also, to assure a sufficient width of the fusing nip N owing to an appropriate thickness of the elastic layer 142. In other words, the heating unit 102 may emit a first heat to a first surface of a recording medium S, while the press roller 104 emits a second heat different from the first heat to a second surface of the recording medium S. Accordingly, an increased amount of heat may be delivered to the recording medium S as it passes through nip N, as discussed in greater detail below.

The at least one heating element 200 may include electrically conductive heating particles 210 dispersed in the elastic layer 142, which emit heat in response to electrical current. That is, the heating particles 210 may convert electric energy supplied to the elastic layer 142 into thermal energy, enabling heat generation from the interior of the elastic layer 142.

The heating particles 210 may include electrically conductive carbon particles. For example, the heating particles 210 may include, but are not limited to, granite, carbon black, activated carbon, and carbon nanotubes. For example, carbon nanotubes may exhibit sufficient heating effects even using a relatively small amount of particles owing to superior electrical conductivity and thermal conductivity thereof.

Figure 12:
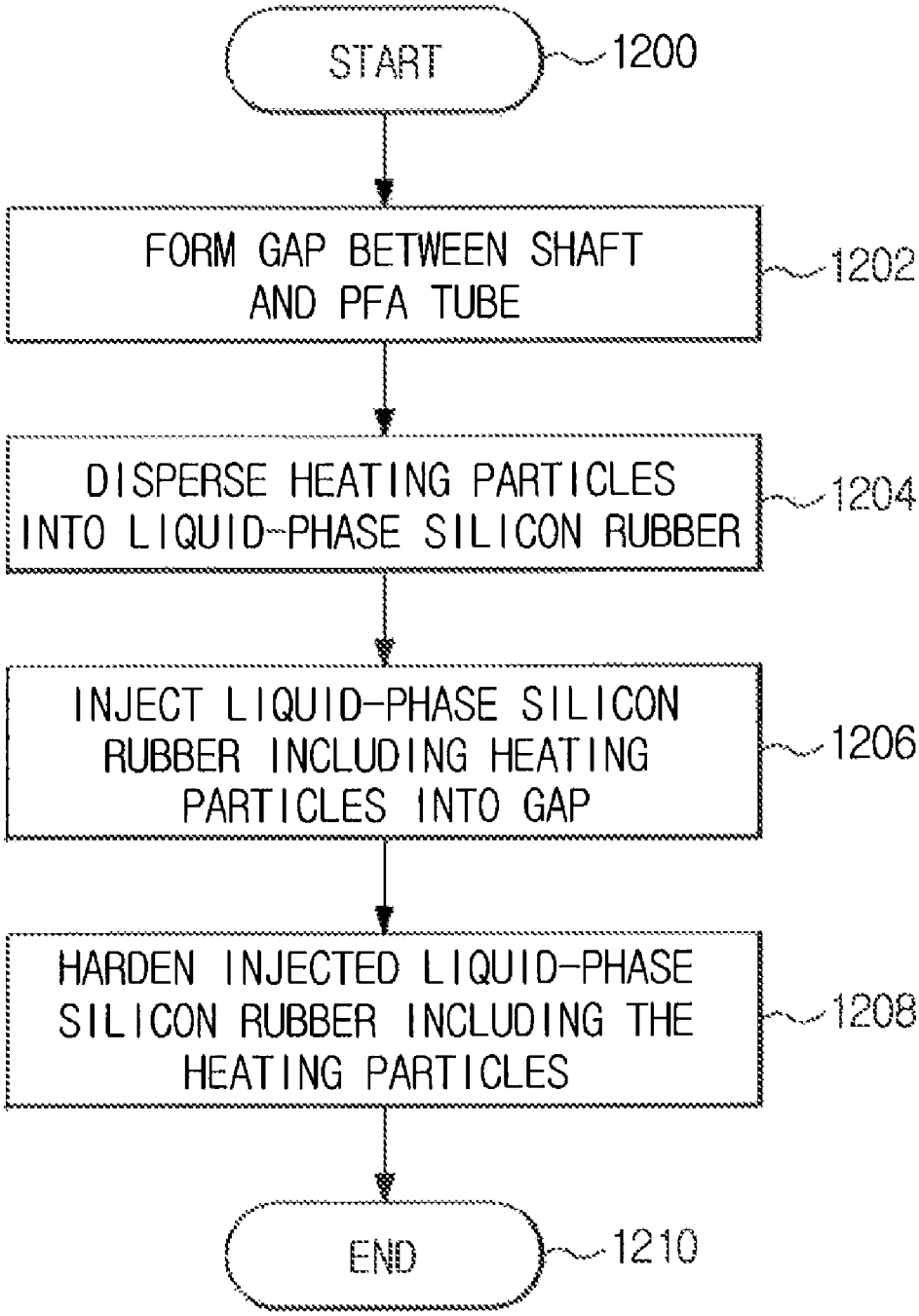
FIG. 12 is a flowchart illustrating exemplary method of fabricating a press roller including elastic layer according to the general inventive concept.

Referring to FIG. 12, a flowchart illustrates an exemplary method of fabricating the elastic layer 142 of the press roller 104. The method begins at operation 1200, and proceeds to operation 1202 where a gap G is formed between the shaft 141 of the press roller 104 and the release layer 143. As mentioned above, the release layer 143 may include a PFA tube 143. At operation 1204, the elastic layer 142 may be fabricated by dispersing heating particles 210 into liquid-phase silicon rubber. The resulting material, i.e., the liquid-phase silicon rubber including the heating particles 210, is injected into the gap G between the shaft 141 and the PFA tube 143 at operation 1206. In operation 1208, the injected material, i.e., the liquid-phase silicon rubber including the heating particles 210, is hardened, and the method ends at operation 1210.

Alternatively, the elastic layer 142 may be fabricated by forming a liquid-phase silicon rubber sheet in which heating particles are dispersed via various coating methods (e.g., spin coating, slit coating or spray coating), and then attaching the sheet to the shaft 141.

An insulation layer 144 may be interposed between the shaft 141 and the elastic layer 142. The insulation layer 144 electrically insulates the shaft 141 from the elastic layer 142 to which electric power is applied. The insulation layer 144 may be made of a high electric resistance material, such as rubber or polyimide. The insulation layer 144 may be formed by performing oxide film coating on a surface of the shaft 141 coming into contact with the elastic layer 142.

As illustrated in FIG. 4, roller caps 145 may be coupled to both axial ends of the press roller 104. The roller caps 145 may be coupled to both ends of the shaft 141 so as to be rotated along with the press roller 104.

An annular recess **145*a* is formed in an outer surface of each of the roller caps 145, and a terminal 146 is accommodated in the recess 145*a*. The body 5 of the image forming apparatus 1 is provided with a power supply terminal 6 corresponding to the terminal 146 of the roller cap 145. The power supply terminal 6 is elastically connected both to a power source 7 provided in the body 5 and the elastic layer 142, thereby supplying power to the elastic layer 142. The power supply terminal 6 of the body 5 is biased toward the terminal 146 of the roller cap 145 by an elastic member 8**.

Once the fusing device 100 is mounted in the body 5 of the image forming apparatus 1, the terminal 146 of the roller cap 145 comes into contact with the power supply terminal 6. The terminal 146 of the roller cap 145 may have an annular shape so as to be continuously kept in contact with the power supply terminal 6 during rotation of the press roller 104.

The terminal 146 of the roller cap 145 may be elastically connected to the elastic layer 142 via a connection terminal 147. The connection terminal 147 penetrates through the roller cap 145 in an axial direction of the press roller 104. One end of the connection terminal 147 comes into contact with the terminal 146 of the roller cap 145 and the other end of the connection terminal 147 is inserted into the elastic layer 142.

The roller cap 145 may be made of an electrically insulating material, to prevent current from being applied to the shaft 141 through the roller cap 145.

If power is supplied to the elastic layer 142 through the power supply terminal 6, the terminal 146 of the roller cap 145 and the connection terminal 147, the heating particles 210 dispersed in the elastic layer 142 generate heat in response to a current flowing therethrough, thereby raising a temperature of the overall elastic layer 142.

The heated press roller 104 transfers a sufficient amount of heat to the recording medium S passing through the fusing nip N in cooperation with the heating unit 102. Accordingly, it may be possible to prevent deterioration in fusing performance even during a high speed printing operation.

As discussed above, the heating unit 102 including the fusing belt 120 may heat only one surface of the recording medium S. Consequently, the recording medium S may curl due to a temperature difference between both surfaces of the recording medium S. However, since heat is transferred to both front and rear surfaces of the recording medium S according to exemplary embodiments of the present general inventive concept, curling phenomenon of the recording medium may be substantially reduced.

Figure 5:
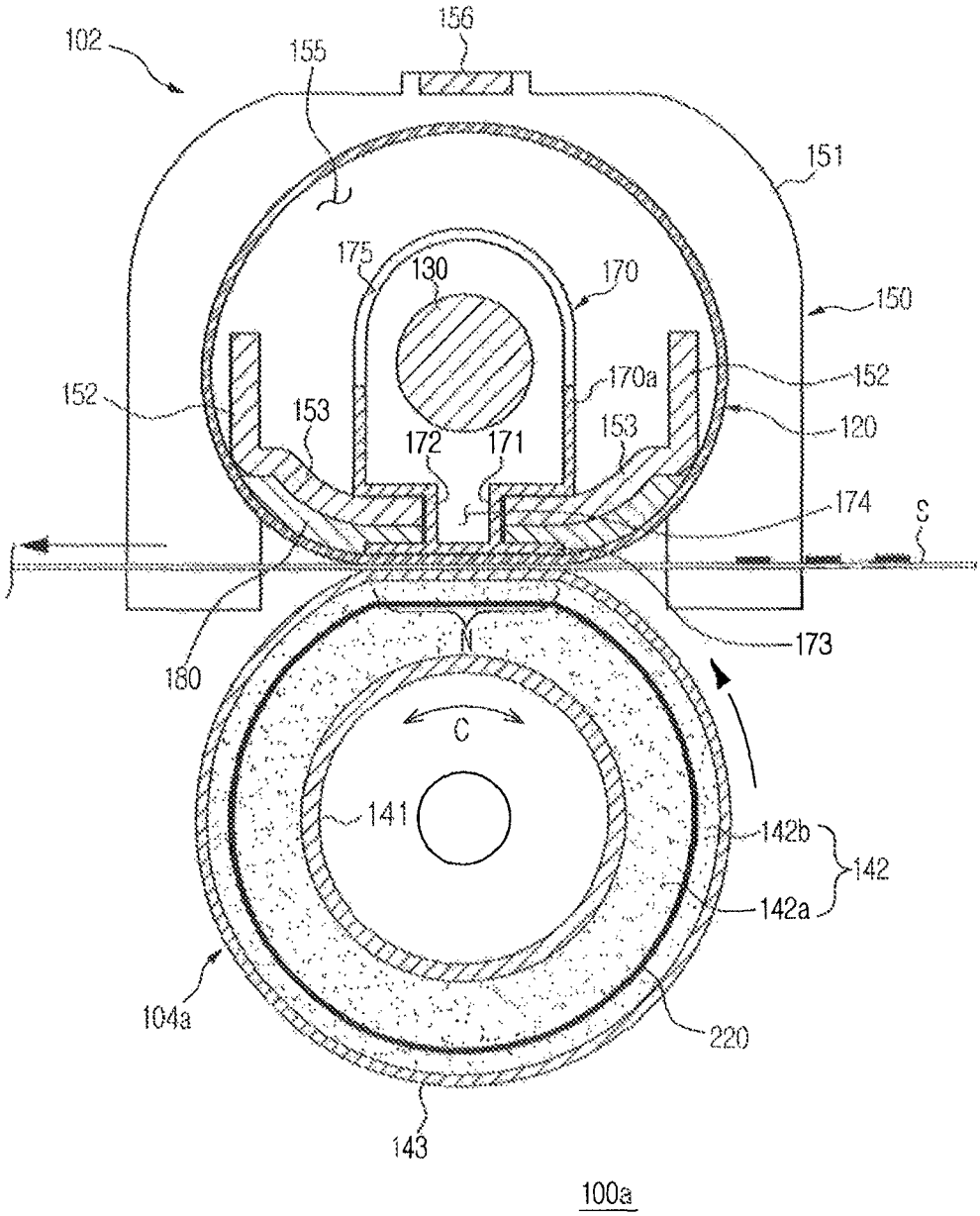
FIGS. 5 and 6 are sectional views illustrating a fusing device according to another exemplary embodiment of the present general inventive concept.
Figure 6:
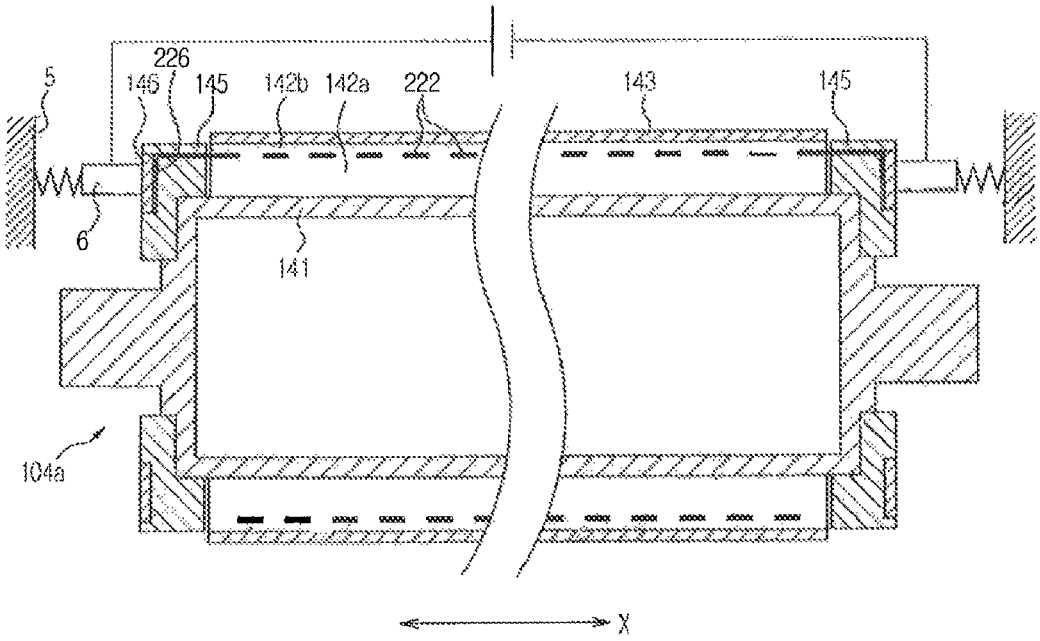
Figure 7:
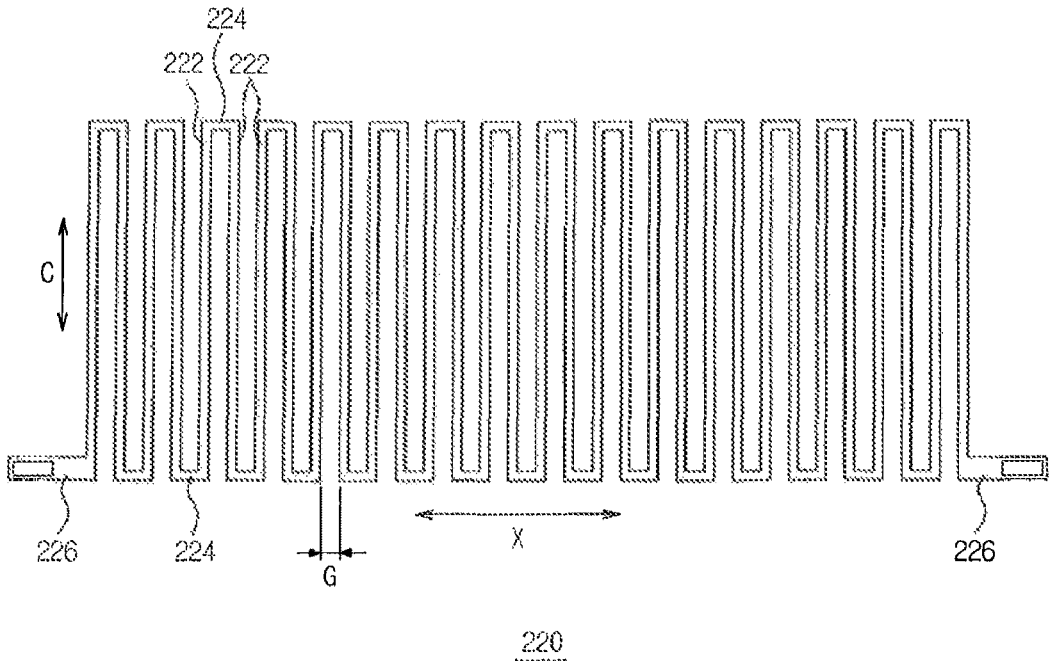
FIG. 7 is a plan view illustrating a sheet type heating element inserted in a press roller of FIGS. 5 and 6.

FIGS. 5 and 6 are sectional views illustrating a fusing device according to another exemplary embodiment of the present general inventive concept, Hereinafter, a repetitious description of common configurations with the fusing device illustrated in FIGS. 3 and 4 will be omitted. Further, in FIGS. 5 and 6, common configurations of FIGS. 3 and 4 are designated by the same reference numerals. FIG. 7 is a plan view illustrating a sheet-type heating element inserted in a press roller of FIGS. 5 and 6.

Referring now to exemplary embodiments illustrated in FIGS. 5 to 7, a fusing device 100*a* includes the heating unit 102 and a press roller 104*a*. The press roller 104*a* includes at least one sheet type heating element 220 disposed in the elastic layer 142 to generate heat from the interior of the elastic layer 142. The sheet type element 220 may be disposed circumferentially in the elastic layer to define a heating layer in press roller 104*a*.

The sheet type heating element 220 may divide the elastic layer 142 into an inner elastic layer 142*a* and an outer elastic layer 142*b*. The inner and outer elastic layers 142*a*, 142*b* are arranged at inner and outer sides of the sheet type heating element 220, respectively, in a radial direction of the press roller 104*a*.

The inner layer 142*a* and the outer layer 142*b* of the elastic layer 142 may be made of the same material, or may be made of different materials from one another. For example, the outer layer 142*b* of the elastic layer 142 may be made of a higher thermal conductivity material than the inner layer 142*a*.

The sheet type heating element 220 may be arranged to cover the periphery of the inner layer 142*a* in a circumferential direction of the press roller 104*a*. The sheet type heating element 220 may have a length equal to a maximum width of the recording medium S passing through the fusing nip N (i.e. an axial length of the press roller).

Once the heating element 220 in the form of a sheet is prepared, the sheet type heating element 220 may be cylindrically wound and disposed in the elastic layer 142 of the press roller 104*a* in the course of fabricating the press roller 104*a*. To this end, a shape of the sheet type heating element 220 may be deformable. The sheet type heating element 220 may be formed by patterning a metal sheet having a thickness, for example, of 30 μm~100 μm. The patterning of the metal sheet may be performed via various fabrication processes, including, but not limited to, an etching process.

Figure 13:
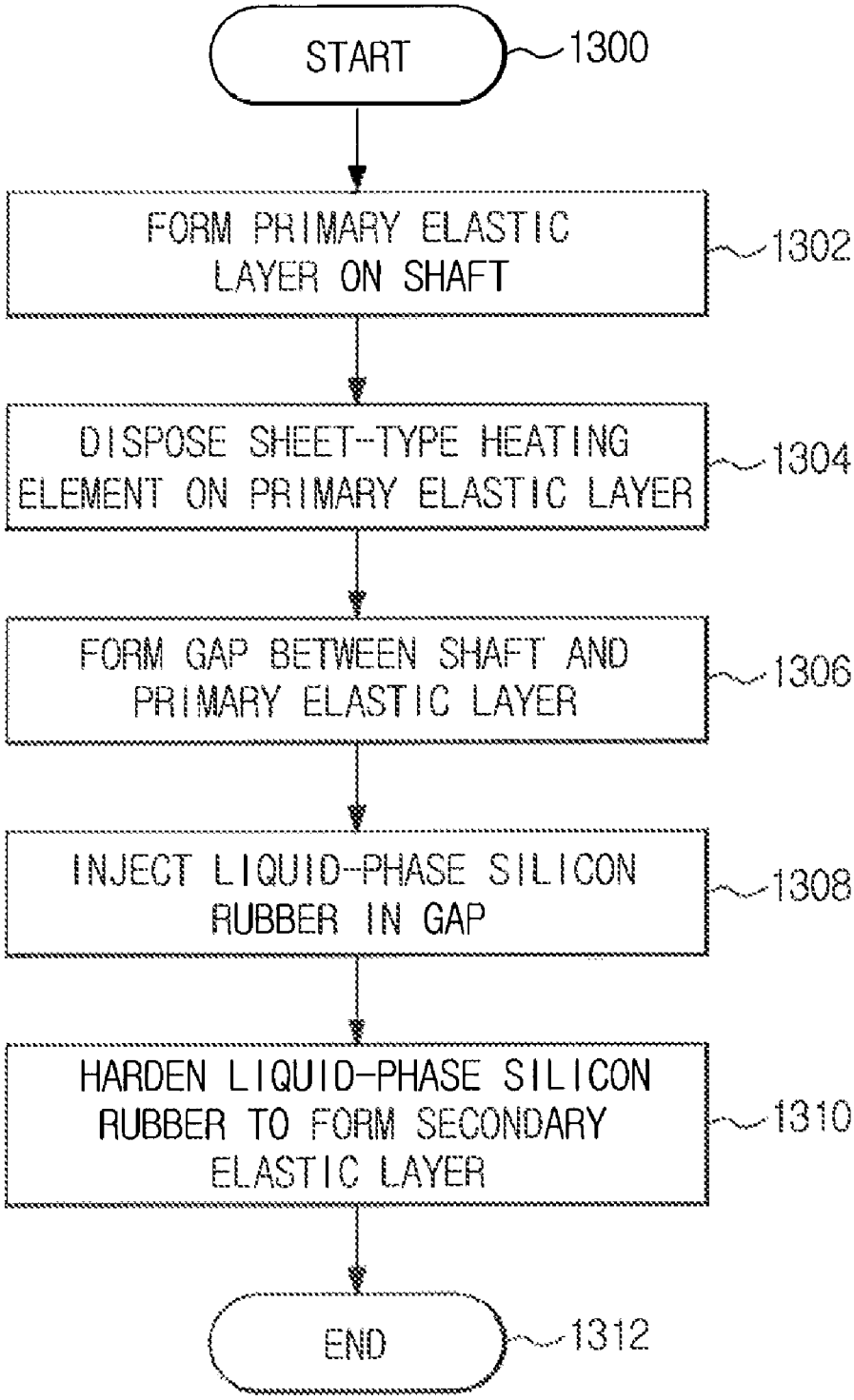
FIG. 13 is a flowchart illustrating an exemplary method of fabricating an alternative press roller according the general inventive concept.

Referring to FIG. 13, a flowchart illustrates an exemplary method of fabricating an alternative press roller 104*a* discussed above. The method begins at operation 1300 and proceeds to operation 1302 where a primary elastic layer (inner layer) 142*a* is formed on the shaft 141. The shaft may also include a release layer 143, for example as a PFA tube 143 surrounding the shaft 141, such that the primary elastic layer 142*a* is formed on the PFA tube 143. In operation 1304, a sheet type heating element 220 may be fixed on the primary elastic layer 142*a*. At operation 1306, a gap G is formed between primary elastic layer 142*a* and shaft 141. If the shaft includes the PFA tube 143, the gap may be formed between the primary elastic layer 142*a* and the PFA tube 143. At operation 1308, liquid-phase silicon rubber may be injected into the gap G. The liquid-phase silicon rubber is hardened to form a secondary elastic layer (outer layer) 142*b* at operation 1310, and the method ends at operation 1312.

The sheet type heating element 220 may include thermal conducting unit patterns 222 arranged according to a predetermined interval in an axial direction (X) of the press roller 104*a*.

The unit patterns 222 may extend in a circumferential direction (C) of the press roller 104*a*. The respective neighboring two unit patterns 222 are connected to each other via thermal conducting connection patterns 224. In FIG. 7, the direction designated by the arrow C may not indicate the circumferential direction of the press roller 104*a* in the strict sense of the word, but may correspond to the circumferential direction of the press roller 104*a* when the sheet type heating element 220 is cylindrically wound inside the press roller 104*a*.

In an exemplary embodiment illustrated in FIGS. 7-10, two connection patterns 224 may be allotted to any one unit pattern 222, and may be connected to both ends of the unit pattern 222, such that the sheet type heating element 222 may have a serpentine configuration.

The sheet type heating element 220 may further include one or more electrically conductive terminals 226. The thermals 226 may be integrally formed on the sheet type heating element 220. The terminals 226 may be electrically connected to an external power source at the outside of the press roller 104*a* to supply power to the sheet type heating element 220.

As illustrated in FIG. 6, the roller caps 145 are coupled to both axial ends of the press roller 104*a*. The terminal 146 is accommodated in each of the roller caps 145 and is connected to the power supply terminal 6 provided at the body 5. The terminal 146 of the roller cap 145 may have an annular shape so as to be continuously kept in contact with the power supply terminal 6 during rotation of the press roller 104*a*.

The terminal 226 of the sheet type heating element 220 penetrates through the corresponding roller cap 145 and is connected to the terminal 146 of the roller cap 145. When power is supplied to the sheet type heating element 220 through the power supply terminal 6 and the terminal 146 of the roller cap 145, the heating patterns 222 and 224 generate heat.

Figure 8:
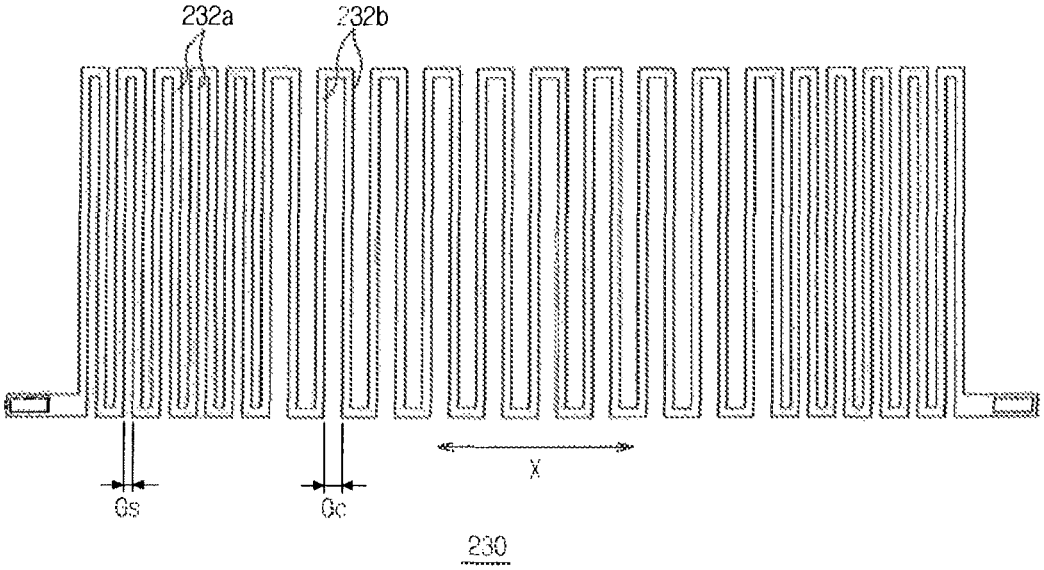
FIGS. 8 to 10 are views illustrating different alternative exemplary embodiments of the sheet type heating element of the fusing device illustrated in FIG. 5.
Figure 9:
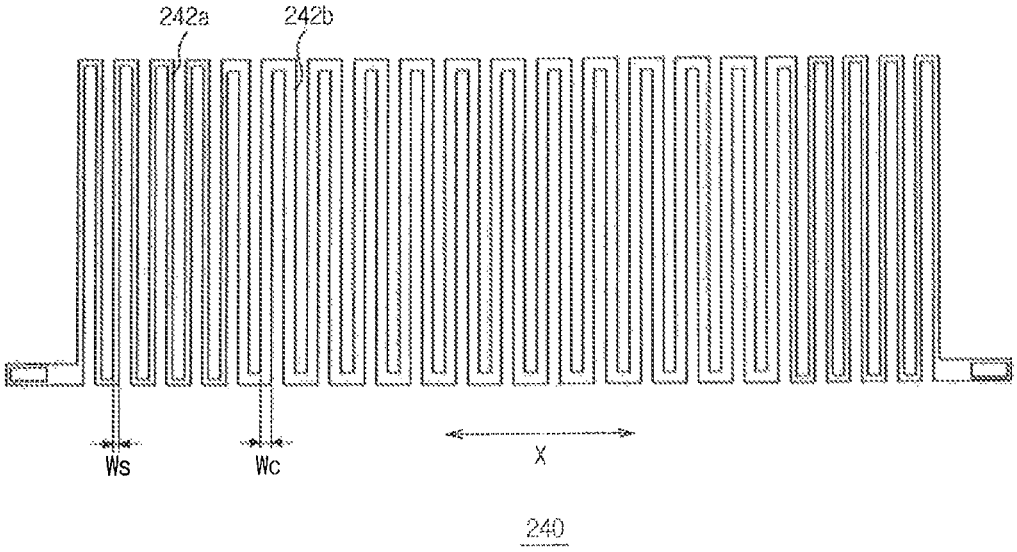

Referring now to FIGS. 7-9, the unit patterns may define a plurality of gaps extending along an axial direction (X). As illustrated in FIG. 7, for example, a gap G between the unit patterns 222 may be even. However, in an alternative exemplary embodiment, the gap between the unit patterns may be changed.

More specifically, shown in an exemplary embodiment illustrated in FIG. 8, one or more side gaps, i.e., gap Gs, located between unit patterns 232*a* of a sheet type heating element 230, which are arranged at both sides of the press roller 104*a* in the axial direction X of the press roller 104*a*, may be narrower than one or more center gaps, i.e., a gap Gc located between unit patterns 232*b* of the sheet type heating element 230 which are arranged at the center of the press roller 104*a* in the axial direction X of the press roller 104*a*. This exemplary embodiment may serve to increase a density of the unit patterns 232*a* arranged at both sides of the press roller 104*a* so as to allow the unit patterns 232*a* to generate a relatively greater amount of heat in consideration of the fact that both sides of the press roller 104*a* have a greater temperature deterioration than the center of the press roller 104*a* when the press roller 104*a* transfers heat to the recording medium S.

In addition, as illustrated in FIG. 9, a width Ws of a sheet type heating element 240, which are arranged at both sides of the press roller 104*a* in the axial direction X of the press roller 104*a*, may be narrower than a width We between unit patterns 242*b* of the sheet type heating element 240 which are arranged at the center of the press roller 104*a* in the axial direction X of the press roller 104*a*. This exemplary embodiment may serve to increase a resistance of the unit patterns 242*a* arranged at both sides of the press roller 104*a* so as to allow the unit patterns 242*a* to generate a relatively greater amount of heat.

Figure 10:
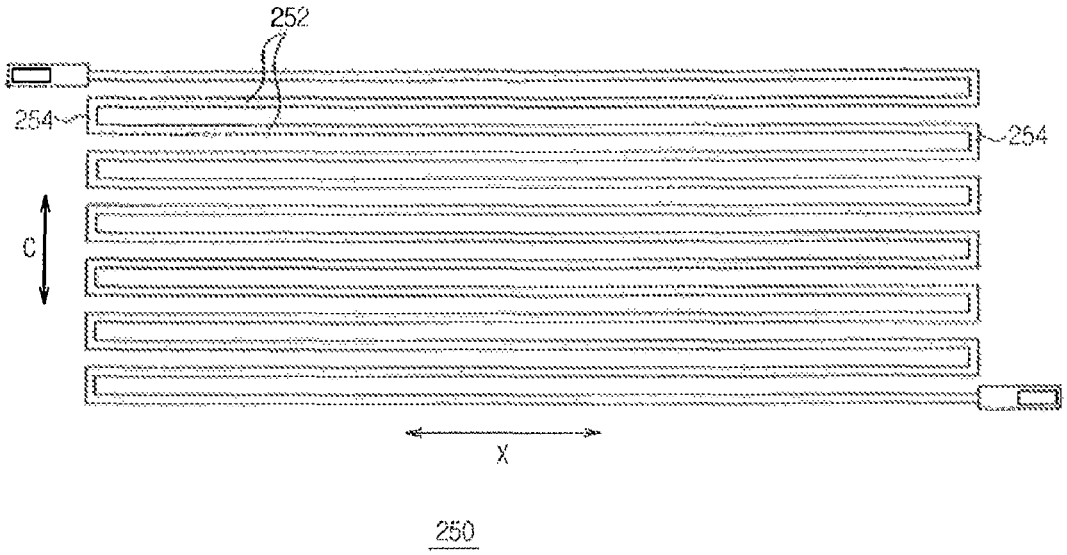

As illustrated in FIG. 10, a sheet type heating element 250 according to an alternative exemplary embodiment may include unit patterns 252 spaced apart from one another in the circumferential direction C of the press roller 104*a*. The unit patterns 252 extend in the axial direction X of the press roller 104*a*, and the respective neighboring two unit patterns 252 are connected to each other via connection patterns 254. As two connection patterns 254 allotted to any one unit pattern 252 are connected to both ends of the unit pattern 252, the sheet type heating element 250 has a serpentine configuration. The sheet type heating element 250 having the above described configuration may be more easily deformed into a cylindrical sheet as compared to the sheet type heating elements illustrated in FIGS. 7 to 9.

Figure 11:
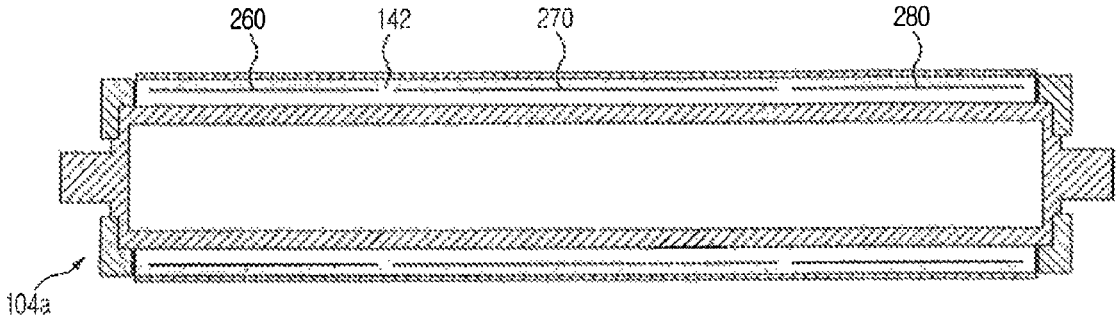
FIG. 11 is a view illustrating an exemplary configuration in which a plurality of sheet type heating elements is provided in the fusing device of FIG. 5.

FIG. 11 is a view illustrating an exemplary embodiment in which a plurality of sheet type heating elements is provided in the fusing device of FIG. 5. In FIG. 11, only the press roller is schematically illustrated.

As illustrated in FIG. 11, a plurality of sheet type heating elements 260, 270 and 280 may be inserted into the elastic layer 142. The sheet type heating elements 260, 270 and 280 may be arranged in the axial direction X of the press roller 104*a*. The first sheet type heating element 270 is arranged at the axial center of the press roller 104*a*, and the second sheet type heating element 260 and the third sheet type heating element 280 are arranged at opposite sides of the first sheet type heating element 270. The sheet type heating elements 260, 270 and 280 may be controlled independently of one another.

For example, the second and third sheet type heating elements 260 and 280 may be controlled to generate a greater amount of heat than the first sheet type heating element 270. This may prevent temperature deterioration at both ends of the press roller 104*a* when the press roller 104*a* transfers heat to the recording medium, resulting in enhanced fusing performance.

In another alternative exemplary embodiment, only the centrally located first sheet type heating element 270 of the sheet type heating elements 260, 270 and 280 may be controlled to generate heat. When the image forming apparatus 1 performs a printing operation on a small recording medium (for example, an envelope), the recording medium comes into contact with only the center of the press roller 104*a*. In this case, when heat is generated only at the center of the press roller 104*a*, it may be possible to prevent the press roller 104*a* from generating heat from a portion thereof that does not come into contact with the recording medium, thereby preventing energy waste. In addition, it may be possible to prevent overheating of the press roller 104*a* during a continuous printing operation.

Figure 14:
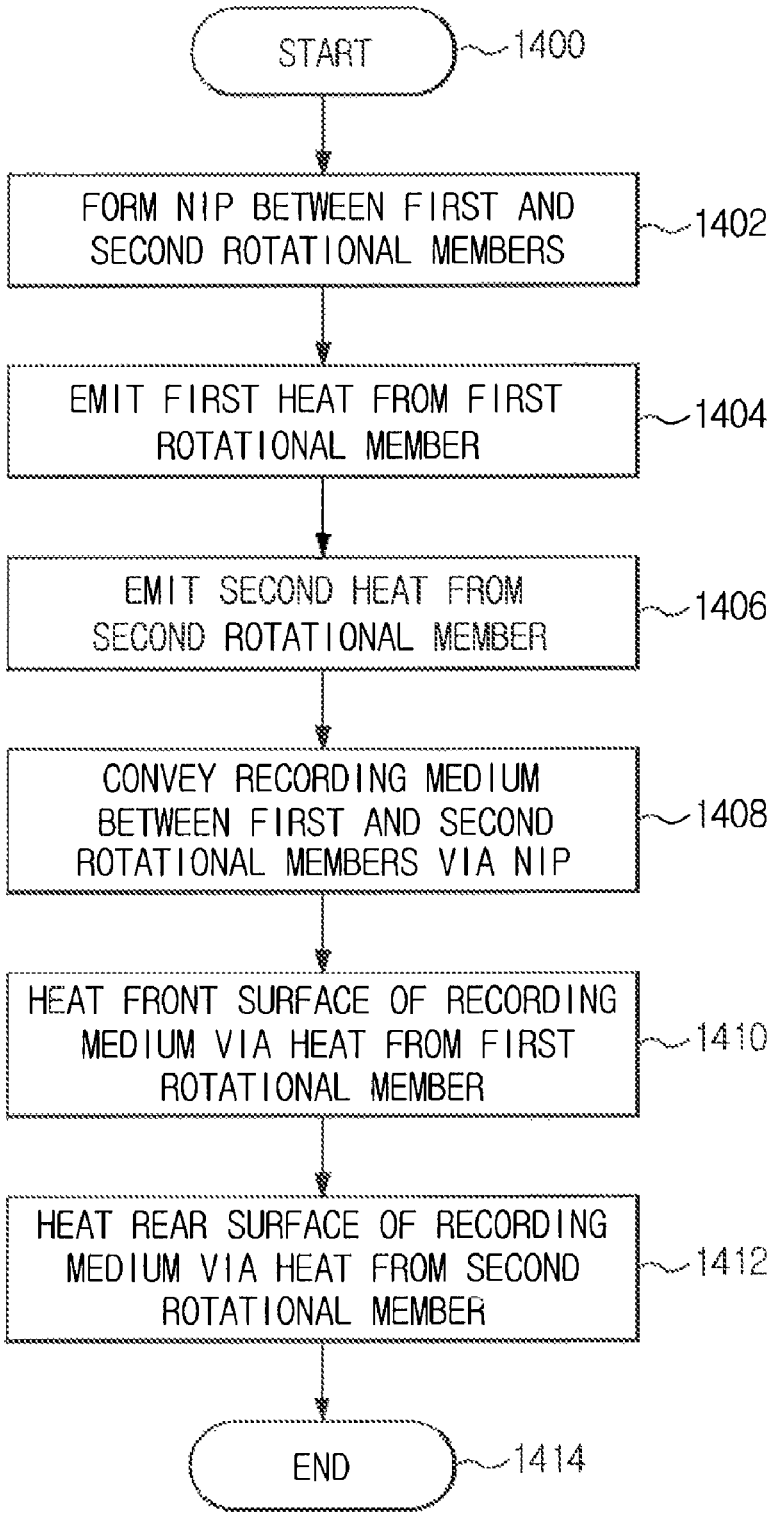
FIG. 14 is a flowchart illustrating an exemplary method of applying heat and pressure to a sheet of recording medium.

Referring now to FIG. 14, a flowchart illustrates an exemplary method of applying heat and pressure to a sheet of recording medium S. At operation 1400, the method begins and proceeds to operation 1402 where a nip N is formed between a first rotational member, such as a fusing belt 120, and a second rotation member, such as a press roller 104. At operation 1404, a first heat is emitted from the first rotational member. At operation 1406, a second heat different from the first heat is emitted from the second rotational member. That is, the first and second rotational members may each include their own individual heat sources to generate separate respective heat. A sheet of recording medium S having a front surface and a rear surface is conveyed between the first and second rotational members via the nip N at operation 1408. As the recording medium S passes through the nip N, both the first and second rotational members press against the front and rears surfaces of the recording medium S. At operation 1410, the front surface of the recording medium S is heated via heat from the first rotational member. The rear surface of the recording medium S is heated via heat from the second rotational member at operation 1412, and the method ends at operation 1414.

As apparent from the above description, according to the exemplary embodiments, it may be possible to supply an increased amount of heat to a recording medium passing through a fusing nip. This results in enhanced fusing performance and higher print speed of the image forming apparatus. In addition, heat may be applied directly to front and rear surfaces of a recording medium passing through the fusing nip, such that the recording medium is less likely to curl.

Although a few exemplary embodiments of the present general inventive concept have been shown and described, it would be appreciated by those skilled in the art that changes may be made in these exemplary embodiments without departing from the principles and spirit of the general inventive concept, the scope of which is defined in the claims and their equivalents.

What is claimed is:

1. A fusing device usable with an image forming apparatus to apply heat and pressure to a recording medium passing through a fusing nip, the fusing device comprising:

a heating unit having a heat source to generate heat; and a press roller arranged to come into contact with and to press the heating unit, wherein the press roller comprises:

a shaft;

an elastic layer arranged to cover a periphery of the shaft and having elasticity to define the fusing nip when the press roller comes into compressive contact with and presses the heating unit; and heating particles dispersed in the elastic layer to generate heat upon receiving electric power supplied to the elastic layer.

2. The fusing device according to claim 1, wherein the heating particles include carbon particles.

3. The fusing device according to claim 1, further comprising an insulation layer arranged between the shaft and the elastic layer to electrically insulate the shaft from the elastic layer.

4. The fusing device according to claim 1, further comprising an annular terminal arranged at either axial end of the press roller so as to be rotated along with the press roller and electrically connected to the elastic layer.

5. The fusing device according to claim 4, further comprising:

a roller cap made of an electrically insulating material and coupled to the axial end of the press roller so as to be rotated along with the press roller, the roller cap being configured to accommodate the annular terminal therein; and a connection terminal penetrating through the roller cap to connect the elastic layer and the annular terminal to each other.

6. The fusing device according to claim 1, wherein the heating unit includes:

a fusing belt arranged to circulate around the heat source;

a supporting member arranged to support a part of an inner circumferential surface of the fusing belt and having an opening to allow the heat generated by the heat source to be directly radiated to the fusing belt; and a nip defining member arranged to support the inner circumferential surface of the fusing belt and having a press portion opposite the press roller to define the fusing nip between an outer circumferential surface of the fusing belt and the press roller.

7. A fusing device usable with an image forming apparatus to apply heat and pressure to a recording medium passing through a fusing nip, the fusing device comprising:

a heating unit having a heat source to generate heat; and a press roller arranged to come into contact with and to press the heating unit, wherein the press roller comprises:

a shaft;

an elastic layer arranged to cover a periphery of the shaft and having elasticity to define the fusing nip when the press roller comes into compressive contact with and presses the heating unit; and at least one sheet type heating element inserted into the elastic layer to allow generation of heat from the interior of the elastic layer.

8. The fusing device according to claim 7, wherein:

the at least one sheet type heating element includes unit patterns extending in a circumferential direction of the press roller; and the unit patterns are arranged with an interval therebetween in an axial direction of the press roller.

9. The fusing device according to claim 8, wherein a gap between the unit patterns of the sheet type heating element, arranged at axial both sides of the press roller, is narrower than a gap between the unit patterns of the sheet type heating element arranged at the axial center of the press roller.

10. The fusing device according to claim 8, wherein a width of the unit patterns of the sheet type heating element, arranged at axial both sides of the press roller, is narrower than a width of the unit patterns of the sheet type heating element arranged at the axial center of the press roller.

11. The fusing device according to claim 7, wherein:

the at least one sheet type heating element includes unit patterns extending in an axial direction of the press roller; and the unit patterns are arranged with an interval therebetween in a circumferential direction of the press roller.

12. The fusing device according to claim 7, wherein the elastic layer includes an inner layer and an outer layer arranged inside and outside of the at least one sheet type heating element in a radial direction of the press roller.

13. The fusing device according to claim 7, wherein the at least one sheet type heating element includes a plurality of sheet type heating elements arranged in an axial direction of the press roller to enable independent control of the amount of heat generated from the respective sheet type heating elements.

14. The fusing device according to claim 7, wherein the at least one sheet type heating element is made of a metal sheet having a thickness of about 30 μm to about 100 μm.

15. The fusing device according to claim 7, further comprising:

a roller cap made of an electrically insulating material and coupled to either axial end of the press roller so as to be rotated along with the press roller; and at least one terminal accommodated in the roller cap so as to be electrically connected to the at least one sheet type heating element.

16. An image forming apparatus, comprising:

a fusing device to apply heat and pressure to a recording medium passing through a fusing nip to fix a non-fused image to the recording medium, wherein the fusing device comprises:

a fusing belt arranged to come into contact with a surface of the recording medium on which the non-fused image is formed, so as to transfer heat to the surface of the recording medium;

a heat source configured to generate heat and arranged to directly radiate the heat to at least a part of an inner circumferential surface of the fusing belt;

a press roller arranged to come into contact with and to press an outer circumferential surface of the fusing belt; and a nip defining member arranged to support the inner circumferential surface of the fusing belt while being arranged opposite the press roller to define the fusing nip between the outer circumferential surface of the fusing belt and the press roller, wherein the press roller includes a shaft, an elastic layer arranged to cover a periphery of the shaft and having elasticity to define the fusing nip when the press roller comes into contact with and presses the heating unit, and at least one heating element accommodated in the elastic layer to generate heat upon receiving electric power supplied to the elastic layer.

17. The image forming apparatus according to claim 16, wherein the at least one heating element includes heating particles dispersed in the elastic layer to generate heat upon receiving electric power supplied to the elastic layer.

18. The image forming apparatus according to claim 17, wherein the heating particles include carbon nanotubes.

19. The image forming apparatus according to claim 16, wherein the at least one heating element includes at least one sheet type heating element inserted into the elastic layer.

20. The image forming apparatus according to claim 16, further comprising:

a power source; and a power supply terminal electrically connected to the power source and arranged at the outside of the press roller, wherein the fusing device further includes a roller cap made of an electrically insulating material and coupled to either axial end of the press roller so as to be rotated along with the press roller, and a terminal accommodated in the roller cap so as to come into contact with the power supply terminal and electrically connected to the heating element.

* * * * *